US005509216A

United States Patent [19]

Becker et al.

[11] Patent Number: 5,509,216

[45] Date of Patent: Apr. 23, 1996

[54] APPARATUS FOR DRYING PARTICULATE MATERIAL

[75] Inventors: Achim Becker, Darmstadt; Michael Elotos, Biebesheim, both of Germany

[73] Assignee: SOMOS GmbH, Weiterstadt, Germany

[21] Appl. No.: 359,819

[22] Filed: Dec. 20, 1994

[30] Foreign Application Priority Data

Dec. 24, 1993 [DE] Germany ..... 43 44 593.4

[51] Int. Cl.[6] ..... F26B 19/00; F26B 21/06

[52] U.S. Cl. ..... 34/219; 34/77

[58] Field of Search ..... 34/576, 577, 582, 34/585, 218, 219, 77, 78, 79, 366; 110/245

[56] References Cited

U.S. PATENT DOCUMENTS

| | | | |
|---|---|---|---|
| 1,829,477 | 10/1931 | Douthitt | 34/366 X |
| 3,913,242 | 10/1975 | Fackler et al. . | |
| 4,038,758 | 8/1977 | Miller . | |
| 4,191,526 | 3/1980 | Triebel | 432/58 |
| 4,199,872 | 4/1980 | Bischoff | 34/79 |
| 4,241,021 | 12/1980 | Skrzec | 34/582 X |
| 4,413,426 | 11/1983 | Graeff . | |
| 4,441,261 | 4/1984 | Beckmann | 34/565 X |
| 4,555,992 | 12/1985 | Dutu et al. | 110/245 X |
| 4,706,390 | 11/1987 | Kitchen | 34/79 X |
| 4,858,335 | 8/1989 | Roth . | |
| 5,053,203 | 10/1991 | Mauleon et al. | 34/576 X |
| 5,372,791 | 12/1994 | Abdulally | 34/585 X |
| 5,373,648 | 12/1994 | Wolf | 34/29 X |

FOREIGN PATENT DOCUMENTS

| | | |
|---|---|---|
| 2569471 | 2/1986 | France . |
| 3637700 | 8/1988 | Germany . |
| 8910763.2 | 2/1991 | Germany . |
| 145224 | 2/1920 | United Kingdom . |

*Primary Examiner*—Edward K. Look
*Assistant Examiner*—Hoang Nguyen
*Attorney, Agent, or Firm*—Evenson, McKeown, Edwards & Lenahan

[57] ABSTRACT

An apparatus for drying particulate material which has at least one container for the particulate material, which container is connected in a closed air circulating system with an air drying device and a heater. Dry, heated air is moved through the particulate material by a blower in order to extract moisture from the particulate material. The moisture-laden air is discharged from the particulate material container, then dried again and heated by the heater and then is supplied again to the container for the particulate material. A connection for introducing the dry air is provided in the upper region of the particulate material container and leads into a duct which is arranged centrally within the container and which is equipped at its lower end with an air distributor. The duct which extends inside the particulate material container has a heat-insulating construction.

8 Claims, 2 Drawing Sheets

APPARATUS FOR DRYING PARTICULATE MATERIAL

BACKGROUND OF THE INVENTION

This invention relates to an apparatus for drying particulate material comprising at least one particulate material container which is connected in a closed air circulating system with an air drying device and a heater, in which a dry heated gas is moved through the particulate material by means of a blower in order to extract moisture from the particulate material, and air discharged from the particulate material container subsequently is dried again, reheated by means of a heater and then supplied again to the particulate material container, wherein a connection for introducing dry, heated gas is provided in an upper region of the particulate material container, the connection leading into a duct arranged substantially centrally in the container and having a lower end provided with a gas distributor.

An apparatus of this type is disclosed published German Utility Model No. DE-GM 89 10 764.2. This known apparatus supplies dried air via a laterally flanged-on duct to the container for the particulate material; the dried air being heated by an electric heater and flowing into the particulate material to be dried in the lower area of the particulate material container. With this apparatus, the particulate material is heated in the immediate vicinity of the container outlet. The warm dry air flows upwards, heats the particulate material and extracts the moisture from it, and the moisture is discharged through an exhaust air outlet in the upper region of the container.

As the result of the arrangement of the heater on the side of the container for the particulate material and the introduction of heated air there into the container, a temperature difference exists in this area, on the one hand, with respect to the outgoing air and, on the other hand, with respect to the particulate material. In addition, the flow of the particulate material in this area is impaired by the arrangement of the heater and the air supply duct.

U.S. Pat. No. 4,858,335 (=DE 3,637,700) discloses another apparatus for drying particulate material, in which dried heated air is supplied to the center of a container for the particulate material and flows out at the lower end of the container via an air distributing duct.

A disadvantage of this known apparatus is that the air supply duct is surrounded by particulate material and the particulate material directly adjacent the air supply duct is strongly heated and under certain circumstances may suffer thermal damage.

While, in the apparatus disclosed in German Utility Model No. DE-GM 89 10 764.2, the air supply duct, which is mounted laterally on the container, has a disadvantageous effect on the flow of product through the apparatus, the air supply duct in the apparatus disclosed in U.S. Pat. No. 4,858,335, which extends from the top center along the whole cylindrical height of the container, makes it possible to achieve a uniform mass flow of particulate material through the apparatus, but this latter construction has the disadvantage that it is difficult to control the inlet temperature of the air introduced into the granulate.

Thus, for example, in a high-temperature drying system in which the heater is flanged directly to the container and the temperature sensor for the heater control is situated directly behind the heater, the inlet temperature of the drying air introduced into the granulate is lower than the temperature measured by the temperature sensor because considerable radiation losses occur on the downward path through the cold granulates or the cold return air and the drying air will therefore cool down.

If the temperature sensor is arranged directly in the lower portion of the air distributor, this means that the air temperature in the upper portion of the air supply duct is clearly higher and the granules, which are in direct contact with the duct, may be subjected to an excessively high temperature.

SUMMARY OF THE INVENTION

It is therefore an object of the present invention to provide an apparatus for drying particulate material which avoids the above-mentioned disadvantages of the prior art.

It is also an object of the invention to provide an apparatus for drying particulate material which facilitates uniform drying of the particulate material.

Another object of the invention is to provide an apparatus with which it is possible to dry particulate material with low temperature losses.

A still further object of the invention is to provide an apparatus for drying particulate material in which a substantially uniform temperature distribution will exist, both vertically and horizontally.

These and other objects of the invention are achieved in accordance with the present invention by providing an apparatus for drying particulate material comprising at least one particulate material container which is connected in a closed air circulating system with an air drying device and a heater, in which a dry heated gas is moved through the particulate material by means of a blower in order to extract moisture from the particulate material, and moisture-laden air discharged from the particulate material container subsequently is dried again, reheated by means of a heater and then supplied again to the particulate material container, wherein a connection for introducing dry, heated gas is provided in an upper region of the particulate material container, the connection leading into a duct arranged substantially centrally in the container; the duct having a lower end provided with a gas distributor, and the duct being thermally insulated at least inside the particulate material container.

A principal advantage of the invention is that now the thermal energy of the dry, heated gas (e.g. dry, heated air) is made available directly where it is needed, specifically at the drying hopper at the temperature value provided by the control. An unregulated delivery of heat can be effectively prevented by means of the invention.

Particularly in an automatic load-accommodating process, as disclosed in U.S. Pat. No. 4,413,426 (=DE-PS 3,131,471), the invention exhibits a further increase in efficiency. In this known process, the amount of air passed through the drying container for particulate material is decreased when the air exhaust temperature rises, and increased when the air exhaust temperature falls. In this case, the air exhaust temperature is measured directly at the air outlet of the container or in the air return duct. In the present invention as a result of the heat insulation of the duct which supplies the dry, heated air to the container for the particulate material, a false reading of the air exhaust temperature is effectively prevented.

As described above, the invention may be used for drying plastic granules. In a similar manner, it may be used for postcondensation of polyethylene terephthalate (PET). In this case also, it is particularly important to achieve a uniform temperature profile of the granulate during a long residence time. The drying hopper, which in postcondensation of PET is also referred to as a reactor, may also be equipped with a hopper wall heater.

In accordance with an advantageous further embodiment of the invention, the heat-insulated duct is constructed as a double-walled duct. In order to improve the heat insulation, the intermediate space between the two tubes may be evacuated or be filled with a heat-insulating gas.

An alternative embodiment provides the duct with an interior hose or tube which is flexible and heat resistant. This also results in a double-walled duct. The heat transfer can be reduced to a great extent through use of a suitable hose material.

In order to achieve an optimal product flow, it is advantageously provided according to a further embodiment of the invention that the duct for supplying the dry, heated air enters the container concentrically through the top of the container or is inserted through the side at the upper end of the container and transitions to a central position via a bend.

This type of air introduction in conjunction with the insulated air distributor duct becomes more important because it is necessary, particularly in the treatment of polyester granules or polyester chips, to ensure that the drying air has an absolutely uniform residence time spectrum at high temperature.

A uniform postcondensation or drying of polyester granules or polyester chips can only occur in a continuous process if it is ensured that each individual granule has the same residence time with respect to both time and temperature.

In order to avoid further heat losses, it is provided in accordance with a further embodiment of the invention to arrange the heating device for heating the drying gas either in the duct extending inside the container or directly at the point the duct enters the container. Heat conduction losses can thereby be minimized.

These and other features of preferred embodiments of the invention, in addition to being defined in the claims, are disclosed in the specification and the drawings, whereby the individual features may be implemented individually or grouped in the form of subcombinations in embodiments of the invention and in other fields and may represent advantageous as well as separately patentable constructions, for which protection is claimed here.

To the extent that the description of invention or of embodiments of the invention refers to dry air or drying air, this naturally should be understood as applying to air as well as to any type of gas and any type of gas composition. The invention is not limited to the use of a specific gas composition.

BRIEF DESCRIPTION OF THE DRAWINGS

Embodiments of the invention are illustrated in the accompanying drawing and will be explained in further detail in the following.

DETAILED DESCRIPTION OF PREFERRED EMBODIMENTS

Figure 1:
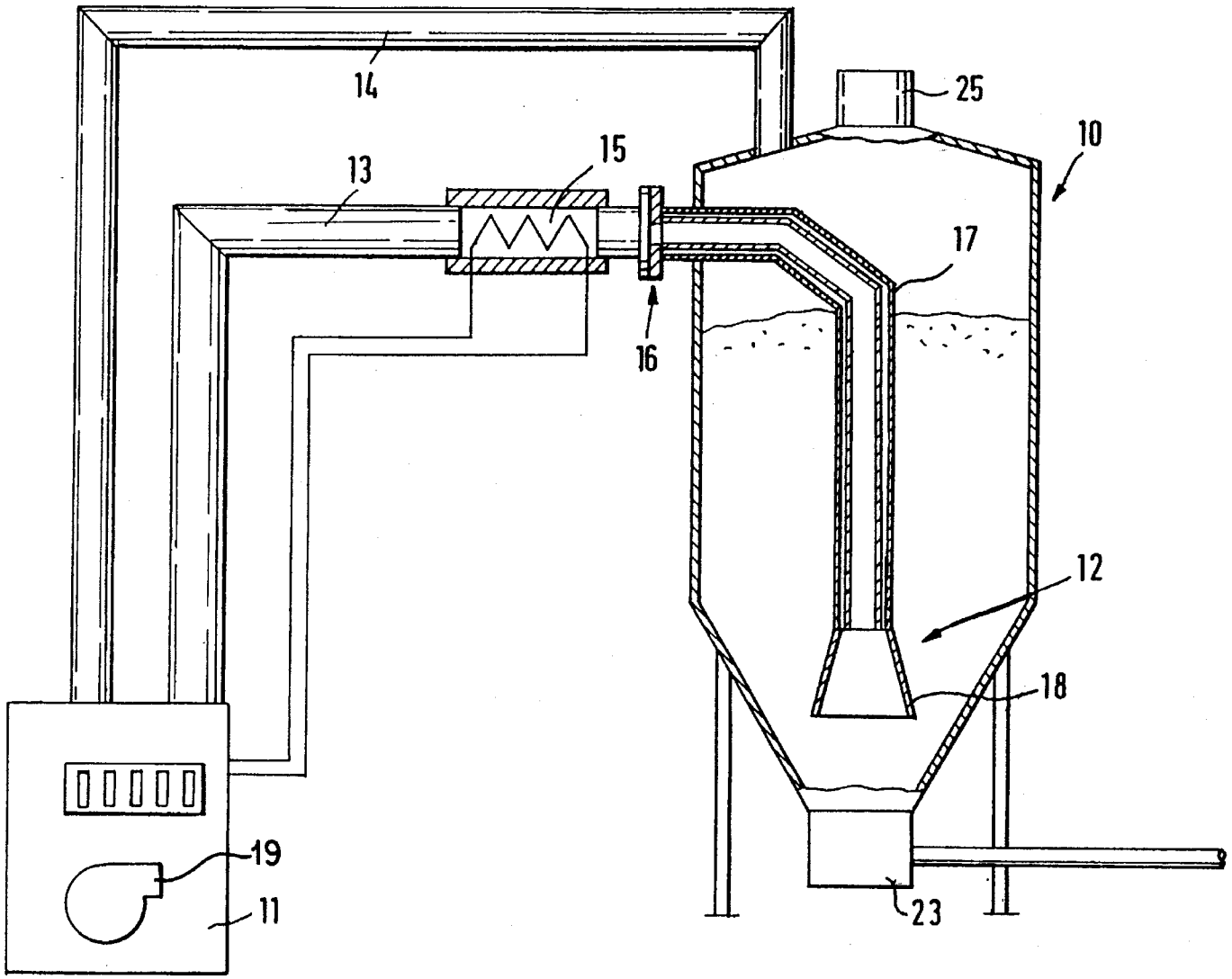
FIGS. 1 and 2 are sectional views of a container for particulate material for drying the particulate material.

FIG. 1 is a schematic view of a container 10 for particulate material which comprises a filler connection 25 via which the particulate material 12 is introduced, a particulate material discharge device 23 and a device 18 for blowing in the dry and heated air. To generate the dry air, an air drying device 11 is provided. Moist air is supplied to this air drying device 11 through an air exhaust duct 14. The air from which the moisture has been removed passes through an air supply duct 13 to the particulate material container 10.

Figure 2:
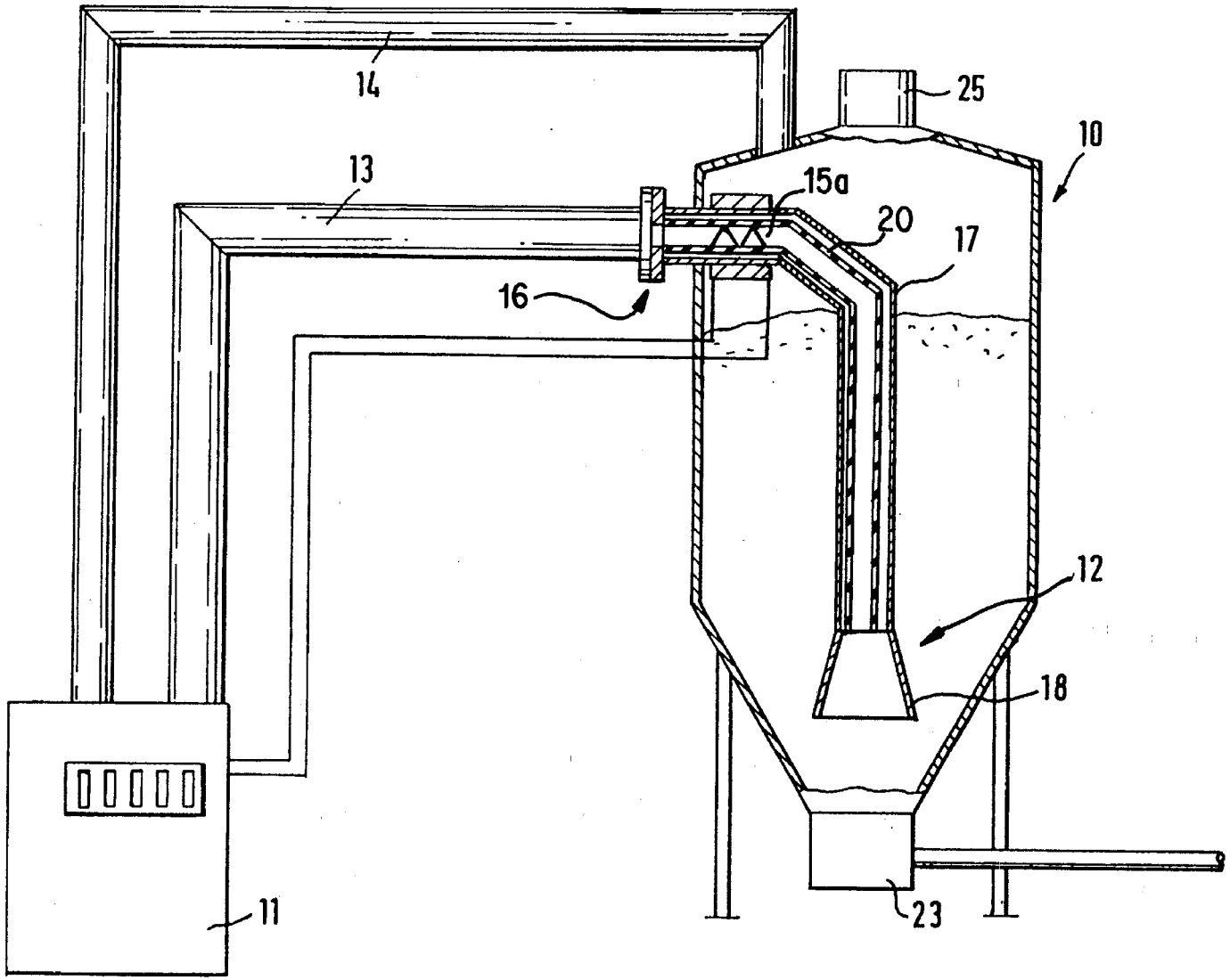

In FIG. 1 only a single container for particulate material is illustrated, however, it is of course possible for the air drying device 11 to supply dry air to additional containers for particulate material. Air drying device 11 is generally known and is described, for example, in U.S. Pat. No. 4,413,426, the disclosure of which is incorporated herein by reference. The drying air is contained in a closed air circuit and is moved by a fan or blower 19 which is arranged in the air drying device 11. The dry air supplied to the container 10 through duct 13 passes through a heating station 15 and subsequently enters the upper region of the container via a flange connection 16 and passes into the interior of the container 10. The duct 17 arranged in the interior of the container 10 for conveying the dry, heated air into the lower region of the container has a double-walled construction. Of course, it is also possible to equip a single-walled duct with an interior flexible hose 20 made, for example, of silicone resin or polyurethane resin (PUR). A very good heat insulation is also achieved by using a flexible hose inside a duct as shown in FIG. 2. FIG. 2 also shows a heater 15*a* arranged inside the duct in the particulate material container. When a double-walled duct is used, as illustrated in the drawing, the intermediate space between the two tubes may be evacuated or filled with a gas.

In the lower region of the container 10, the heated and dried gas flows through a gas distributor 18 into the particulate material which is to be dried, takes up the moisture, and carries this moisture through duct 14 to the air drying device 11.

The apparatus of the invention is also able to increase the efficiency and process reliability in postcondensation of PET. In this postcondensation, the drying process proceeds in a manner similar to the drying process described above, in which temperatures amounting to 200 degrees C. and residence times of over 20 hours must be maintained. In this case, it is also particularly important to achieve a uniform temperature profile of the granulates for a long residence time. In order to prevent temperature gradients, the drying hopper, which is also referred to as a reactor, is additionally provided with a hopper wall heater, for example, in the nature of a double jacket with an oil circulating system.

The foregoing description and examples have been set forth merely to illustrate the invention and are not intended to be limiting. Since modifications of the described embodiments incorporating the spirit and substance of the invention may occur to persons skilled in the art, the scope of the invention should be construed broadly to embrace everything falling within the appended claims and equivalents thereof.

What is claimed is:

1. An apparatus for drying particulate material comprising at least one particulate material container which is connected in a closed air circulating system with an air drying device and a heater, in which a dry heated gas is moved through the particulate material by means of the blower in order to extract moisture from the particulate material, and air discharged from the particulate material container subsequently is dried again, reheated by means of the heater and then supplied again to the particulate material container, wherein a connection for introducing dry, heated gas is provided in an upper region of the particulate material container, said connection leading into a duct arranged substantially centrally in the container; said duct having a lower end provided with a gas distributor, and said duct being thermally insulated at least inside the particulate material container.

2. An apparatus according to claim 1, wherein said dry, heated gas is air.

3. An apparatus according to claim 1, wherein said duct is constructed as a double-wall duct.

4. An apparatus according to claim 1, wherein said duct is provided with an interiorly arranged, thermally stable, flexible hose.

5. An apparatus according to claim 1, wherein said duct is concentrically arranged on the upper end of the particulate material container.

6. An apparatus according to claim 1, wherein said duct is arranged concentrically within the particulate material container.

7. An apparatus according to claim 1, wherein the heater for heating the drying air is arranged inside the duct in the particulate material container.

8. An apparatus according to claim 1, wherein the heater for heating the drying air is arranged at a point where the duct enters the particulate material container.

* * * * *

UNITED STATES PATENT AND TRADEMARK OFFICE

CERTIFICATE OF CORRECTION

PATENT NO. : 5,509,216

DATED : April 23, 1996

INVENTOR(S) : Achim Becker et al.

It is certified that error appears in the above-indentified patent and that said Letters Patent is hereby corrected as shown below:

On the title page, item [75] Inventors: second inventor surname should read --Zlotos--.

Signed and Sealed this

Seventeenth Day of September, 1996

*Attest:*

Bruce Lehman

BRUCE LEHMAN

*Attesting Officer*

*Commissioner of Patents and Trademarks*